US006853149B2

(12) United States Patent
Roh et al.

(10) Patent No.: US 6,853,149 B2
(45) Date of Patent: Feb. 8, 2005

(54) APPARATUS AND METHOD FOR AUTOMATICALLY ADJUSTING RESET RAMP WAVEFORM OF PLASMA DISPLAY PANEL

(75) Inventors: Chung-wook Roh, Yongin-si (KR); Sang-hoon Lee, Seoul (KR); Hye-jeong Kim, Suwon-si (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 28 days.

(21) Appl. No.: 10/349,191

(22) Filed: Jan. 23, 2003

(65) Prior Publication Data

US 2003/0184533 A1 Oct. 2, 2003

(30) Foreign Application Priority Data

Mar. 30, 2002 (KR) ..... 2002-17604

(51) Int. Cl.[7] ..... G09G 5/00; G09G 1/28; G09G 3/10

(52) U.S. Cl. ..... 315/169.4; 345/211; 345/204; 315/169.1; 315/169.2; 315/169.3

(58) Field of Search ..... 345/204, 211, 345/199, 60, 3, 507, 87; 315/169.4, 169.2, 169.3

(56) References Cited

U.S. PATENT DOCUMENTS 5,475,402 A * 12/1995 Hijikata ..... 345/211
5,977,933 A * 11/1999 Wicher et al. ..... 345/3.1
6,459,212 B2 * 10/2002 Tokunaga et al. ..... 315/169.4
6,762,567 B2 * 7/2004 Ide ..... 315/169.4

* cited by examiner

*Primary Examiner*—Don Wong
*Assistant Examiner*—Chuc Tran
(74) *Attorney, Agent, or Firm*—Sughrue Mion, PLLC

(57) ABSTRACT

An apparatus and method for automatically adjusting a gradient of a reset ramp waveform of a plasma display panel in order to automatically adjust a ramp waveform generated in a reset period contributing to deviation adjustments between circuit components and between panels are provided. The apparatus manufacturing process is simple and the reset ramp waveform gradient is automatically adjusted, without manually adjusting the reset ramp waveform gradient, by sensing image information related to a gradient adjustment of the reset ramp waveform of the plasma display panel through a sensor and automatically generating a ramp waveform of a most suitable gradient based on the sensed image information.

22 Claims, 7 Drawing Sheets

APPARATUS AND METHOD FOR AUTOMATICALLY ADJUSTING RESET RAMP WAVEFORM OF PLASMA DISPLAY PANEL

BACKGROUND OF THE INVENTION

This application claims the priority of Korean Patent Application No. 2002-17604, filed Mar. 30, 2002, which is incorporated herein in its entirety by reference.

1. Field of the Invention

The present invention relates to an apparatus and method for driving a plasma display panel, and more particularly, to an apparatus and method for automatically adjusting a gradient of a reset ramp waveform of a plasma display panel, in order to automatically adjust a ramp waveform generated in a reset period, which is a period contributing to deviation adjustments between circuit components and between panels.

2. Description of the Related Art

In general, a plasma display panel (PDP) is a next generation flat display apparatus which indicates characters and images using plasma generated by gas discharge. In the plasma display panel, hundreds of thousands to several millions or more pixels are arranged in a matrix type based on a size of the PDP.

As shown in FIG. 1, a conventional plasma display panel driving circuit includes a scan electrode driving board 110, a plasma display panel (PDP) 120, a common electrode driving board 130, and an address driver integrated circuit (IC) 140.

A driving sequence of the PDP is divided into a reset period, a scan period and a sustain period. The reset period removes a display hysteresis by discharging all cells and simultaneously eliminating wall charges. The scan period selects a discharge cell from a matrix configuration generated by a combination of raw electrode and column electrode so that an address discharge is formed. The sustain period displays an image while repeatedly charging/discharging a discharge cell formed in the scan period using an energy recovery process.

Ramp waveforms as shown in FIGS. 2A and 2B are employed to uniform a wall charge elimination in a cell indicating a prior image signal and stabilize a wall charge generation for indicating a next image signal in the reset period.

Contrast of high quality and reliability of accurate image display discharge in the PDP are greatly affected by a gradient of the ramp waveform applied in the reset period. The ramp waveform generating circuit applied in the reset period of the PDP driving circuit has three type waveforms, that is, an X-rising ramp waveform generator 130A, a Y-rising ramp waveform generator 110C and a Y-falling ramp waveform generator 110D.

The most suitable image is displayed by changing the gradient of the ramp waveform generated in the respective ramp waveform generator based on characteristic deviation between the plasma display panels and characteristic deviation between circuit elements.

Conventionally, the gradient of the ramp waveform was manually adjusted as follows.

FIG. 3 is a detail circuit diagram of a conventional X-rising ramp waveform generator according to the prior art.

A gate driver 31 amplifies an input square wave signal X_rr_sig to supply a sufficient power on order to switch on/off a MOS field effect transistor (MOSFET) switch X31. In case of separating a source terminal of the MOSFET switch X31 from a signal ground line, a sufficient power must be supplied to switch on/off the MOSFET switch X31.

After the input square wave signal X_rr amplified by the gate driver 31 passes through a variable resistor Rg, the signal X_rr is inputted to a gate terminal of the MOSFET switch X31. If the signal X_rr is 'ON' (output end voltage of the gate driver is $V_{gg}$), a gate current $i_g$ flowing through a path $R_g$-$C_{gd}$-$D_2$ is given by the following Equation 1:

$$i_g = \frac{V_{gg} - V_{th}}{R_g} \tag{1}$$

Herein, $V_{th}$ is a threshold voltage of the MOSFET switch X31, typically about 5V. At this time, a voltage rising gradient $dV_{gd}/dt$ of both ends of $C_{gd}$ is expressed as the following Equation 2:

$$\frac{dV_{DG}}{dt} = \frac{dV_{DS}}{dt} = \frac{i_g}{C_{gd}} = \frac{V_{gg} - V_{th}}{C_{gd}} \tag{2}$$

As seen from the above Equation 2, if the variable resistor $R_g$ is adjusted, a voltage gradient between a drain terminal and a source terminal of the MOSFET switch X31 is changed, whereby a voltage gradient of the ramp waveform applied to both ends of the PDP can be adjusted.

If the signal X_rr is 'OFF', the gate current $i_g$ is drastically decreased through a path $C_{gs}$-D1. Herein, $C_{gs}$ is referred to as a parasitic gate-source capacitance of the MOSFET switch X31. FIG. 4 shows a simulation result of a X rising voltage gradient of the PDP according to a change of the variable resistor $R_g$ using $P_{spice}$. It can be seen from FIG. 4 that the gradient of the ramp waveform is reduced as the variable resistor $R_g$ increases.

According to the prior art having the above-described circuit configuration, the gradient of the PDP reset ramp waveform was adjusted by manually adjusting the variable resistor $R_g$ while directly watching an image which is outputted in an image adjustment process step. Thus, there are problems in that the image adjustment process is complex and an accurate image adjustment is difficult to be performed in mass production.

SUMMARY OF THE INVENTION

To solve the above and other problems, it is an object of the present invention to provide an apparatus and method for automatically adjusting a reset ramp waveform of a plasma display panel, in order to automatically adjusting a gradient of a ramp waveform of a plasma display panel for a wall charge elimination in a reset period based on the sensed contrast and brightness of an image outputted to the plasma display panel.

According to an aspect of the present invention, an apparatus for automatically adjusting a reset ramp waveform of a plasma display panel comprises a sensor which senses image information related to a gradient adjustment of a reset ramp waveform of the plasma display panel, a look-up table which stores gradient reference data of the reset ramp waveform corresponding to digital date value of the image information related to the gradient adjustment of the reset ramp waveform, a control circuit which converts the sensed image information into digital data, reads the reset ramp waveform gradient reference data corresponding to the converted digital data value of image information from the look-up table, and converts the read gradient reference data into an analogue signal; and a ramp waveform generating circuit which changes a gradient of the reset ramp waveform according to a level of the reset ramp waveform gradient reference signal which is converted into the analogue signal.

According to another aspect of the present invention, an apparatus for driving a plasma display panel comprises a sensor which senses image information related to a gradient adjustment of the reset ramp waveform of the plasma display panel, a look-up table which stores reset ramp waveform gradient reference data, which corresponds to digital data value of the image information related to the gradient adjustment of the reset ramp waveform and is applied to a reset common electrode and reset scan electrode, respectively, a control circuit which converts the sensed image information by the sensor into digital data, reads the reset ramp waveform gradient reference data which corresponds to the converted digital data value of image information and is respectively applied to the reset common electrode and the reset scan electrode from the look-up table and converts the read ramp waveform gradient reference data into an analogue signal, a common electrode driving circuit which includes a common electrode ramp waveform generating circuit which changes the reset ramp waveform gradient applied to the reset common electrode according to a level of the reset ramp waveform gradient reference signal applied to the reset common electrode which is converted into the analogue signal, thereby generating a driving voltage of the common electrode of the plasma display panel, and a scan electrode driving circuit which includes a san electrode ramp waveform generating circuit which changes the reset ramp waveform gradient applied to the reset scan electrode according to a level of the reset ramp waveform gradient reference signal applied to the reset scan electrode which is converted into the analogue signal, thereby generating a driving voltage to the scan electrode of the plasma display panel.

According to still another aspect of the present invention, a method for controlling a drive of a plasma display comprises the steps of sensing image information related to a gradient adjustment of the reset ramp waveform of the plasma display panel through a sensor, reading reset ramp waveform gradient reference data corresponding to the sensed image information related to the gradient adjustment of the reset ramp waveform from a look-up table, and generating a reset ramp wave signal having a gradient corresponding to the read reset ramp waveform gradient reference data value.

BRIEF DESCRIPTION OF THE DRAWINGS

The above and other object and advantages of the present invention will become more apparent by describing in detail preferred embodiments thereof with reference to the attached drawings in which.

DETAILED DESCRIPTION OF THE INVENTION

Figure 1:
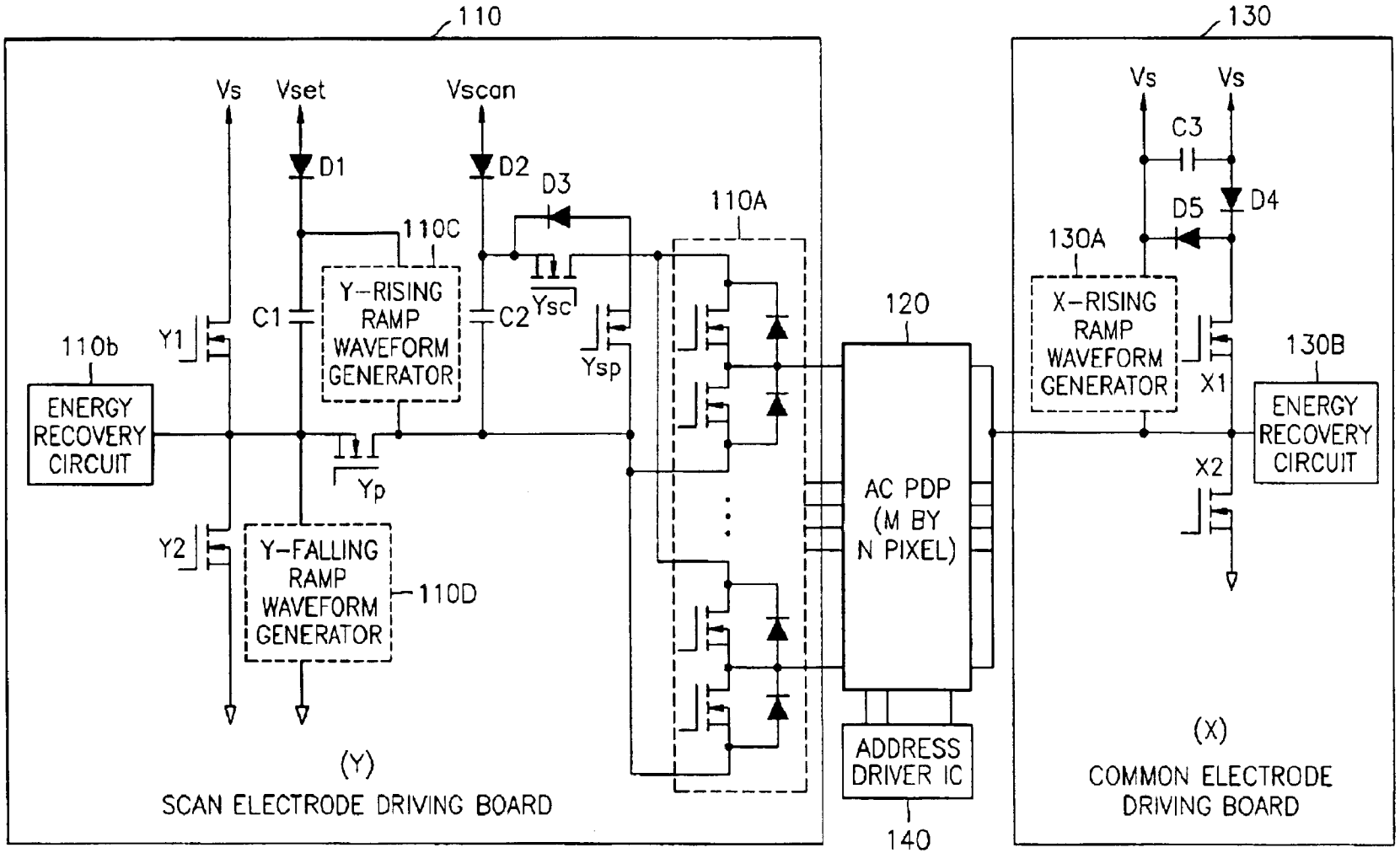
FIG. 1 (PRIOR ART)
FIG. 1 is a configuration view of a plasma display panel (PDP) driving circuit according to the prior art.
Figure 2:
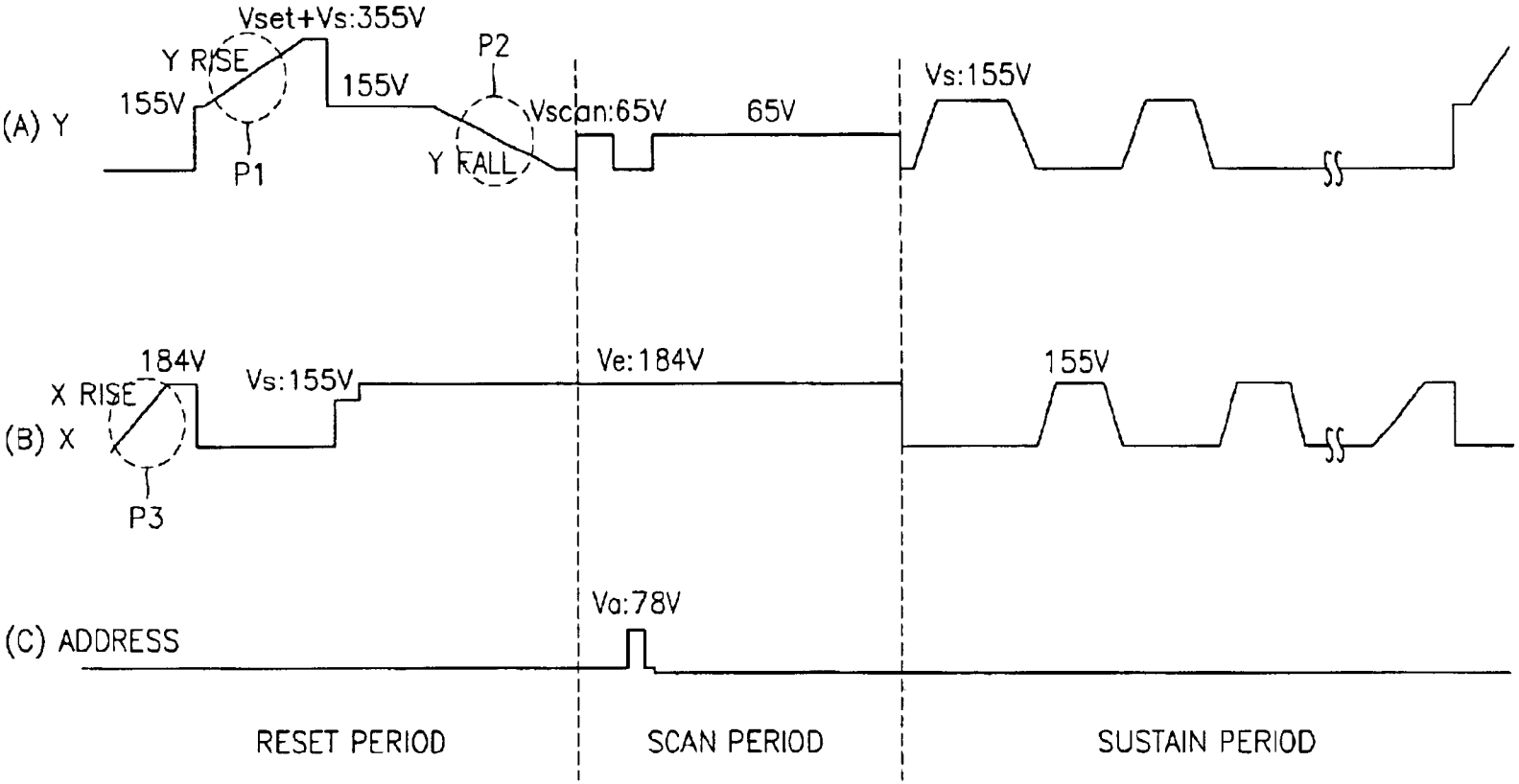
FIG. 2 (PRIOR ART)
FIG. 2, waveforms A–C are diagrams of voltage waveforms according to operation periods of an X-Y electrode of a PDP.
Figure 3:
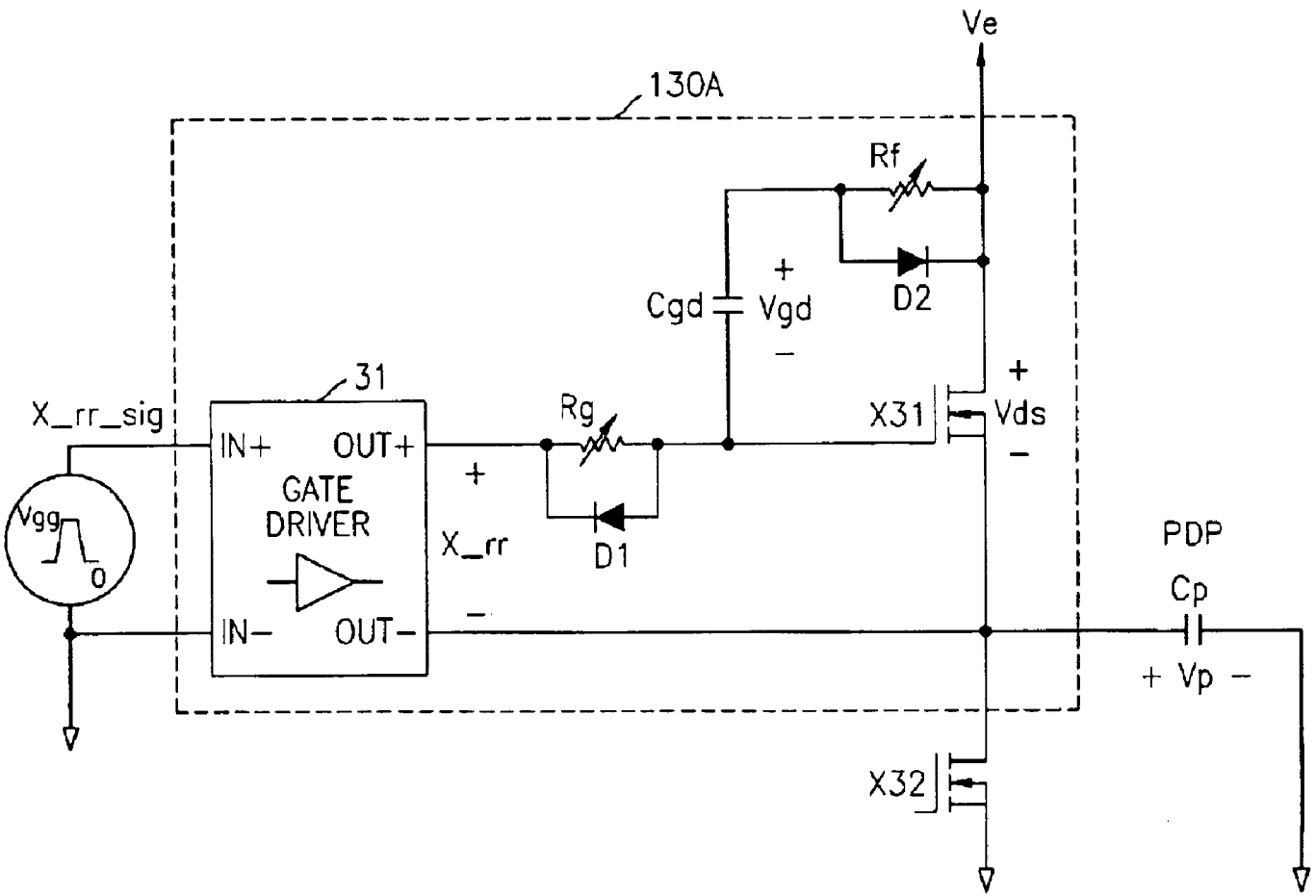
FIG. 3 (PRIOR ART)
FIG. 3 is a detail circuit diagram of the conventional X-rising ramp waveform generator shown in FIG. 1.
Figure 4:
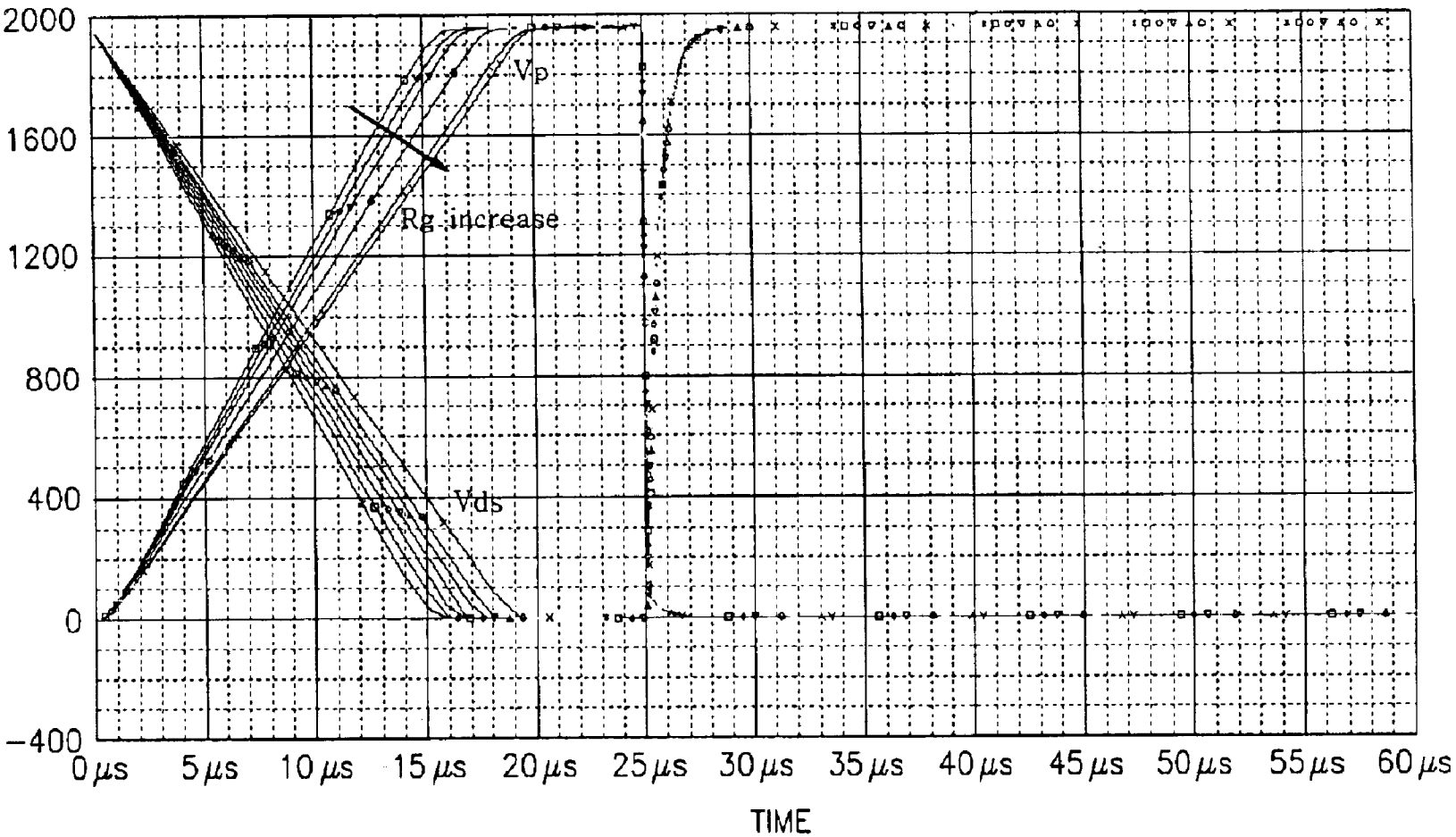
FIG. 4 (PRIOR ART)
FIG. 4 is a diagram of a change of a voltage gradient of the X-rising ramp waveform of the PDP according to a change of a variable resistor in the circuit of FIG. 3.
Figure 5:
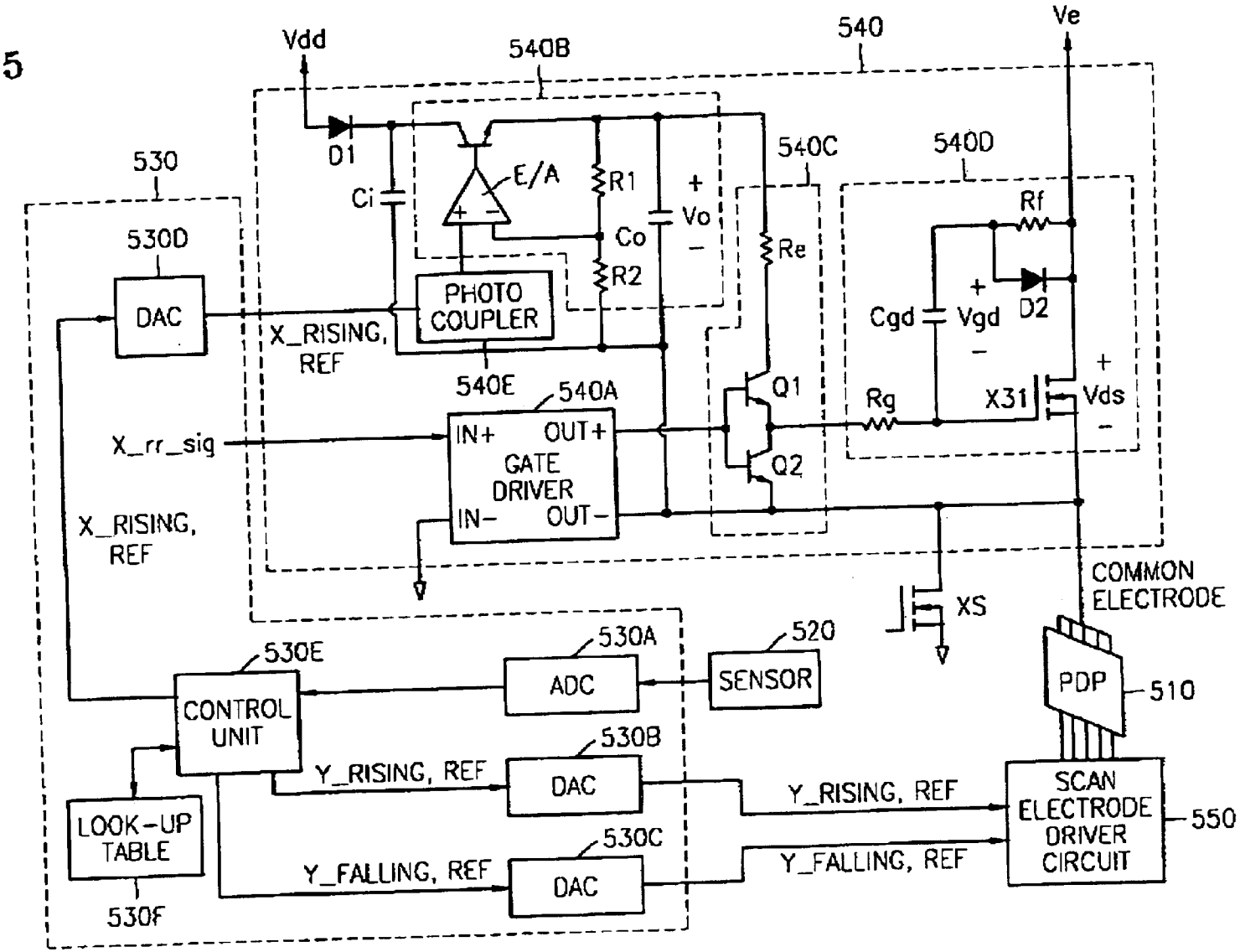
FIG. 5 is a configuration view of a plasma display driving system using an apparatus for automatically adjusting a reset ramp waveform according to the present invention.

As shown in FIG. 5, an apparatus for automatically adjusting a reset ramp waveform of a plasma display panel (PDP) according to the present invention includes a plasma display panel (PDP) 510, a sensor 520, a control circuit 530, a X-rising ramp waveform generating unit 540 and a scan electrode driver circuit 550.

The control circuit 530 includes an analogue-to-digital converter (ADC) 530A, digital-to-analogue converters (DAC) 530B, 530C and 530D, a control unit 530E and a look-up table 530F. The X-rising ramp waveform generating unit 540 includes a gate driver 540A, a regulator 540B, a push-pull buffer 540C, a switching circuit 540D and a photo coupler 540E.

The switching circuit 540D comprises resistors Rg and Rf, a capacitor Cgd, a diode D2, and a MOS field effect transistor (MOSFET) switch X31 and has a function to convert a square wave signal into a ramp waveform signal.

The look-up table 530F is designed such that image information related to a gradient adjustment of the reset ramp waveform sensed from the PDP matches gradient reference data of the reset ramp waveform suitable for the sensed image information and the gradient reference data is stored.

Here, contrast information and image brightness information are examples image information related to the gradient adjustment of the reset ramp waveform. Further, the gradient reference data of the reset ramp waveform includes gradient reference data of Y-rising ramp waveform and gradient reference data of Y-falling ramp waveform applied to a scan electrode of the PDP and gradient reference data of X-rising ramp waveform applied to a common electrode.

The look-up table may be designed by experimentally obtaining the most suitable X/Y ramp waveform gradient applied to a reset period corresponding to the contrast value and brightness value. That is, the most suitable ramp waveform gradient for eliminating wall charge is experimentally determined based on the sensed contrast value and brightness value so that the look-up table is written.

After the contrast and brightness signals of the image displayed in the PDP 510 are sensed through the sensor 520, the sensed contrast and brightness signals are converted into digital signals through the A/D converter 530A and then the digital signals are inputted to the control unit 530.

The control unit 530 reads the gradient information of the ramp waveform corresponding to the inputted contrast and brightness digital signal values from the look-up table 530F. Herein, the ramp waveform gradient information includes Y-rising ramp waveform gradient reference data and Y-falling ramp waveform gradient reference data of a scan electrode and X-rising ramp waveform gradient reference data of a common electrode.

After the X-rising ramp waveform gradient reference data is converted into an analogue signal through the D/A converter 530D, the analogue signal is inputted to the photo coupler 540E.

The reason the photo coupler 540E is used in the X-rising ramp waveform generating unit 540 is that since a source terminal of the MOSFET switch X31 is separated from a ground line, a gradient reference signal X_rr_sig,ref of the X-rising ramp waveform is converted into a signal based on a voltage of a plasma common electrode terminal through a ground line separation of an input/output terminal of the photo coupler 540E.

Although a linear regulator is used as the regulator 540B in an embodiment of the present invention, a switch mode power supply (SMPS) may be used in other embodiments.

The regulator 540B, as shown in FIG. 5, comprises an error amplifier (E/A), resistors R1 and R2 and a capacitor Co. Further, the regulator 540B follows a voltage of the gradient reference signal X_rr_sig,ref of the X-rising ramp waveform applied to the input terminal and outputs the voltage.

A reset square wave signal X_rr_sig of the X-rising timing is inputted to the gate driver 540A so that the gate driver 540A amplifies an input signal for supplying a sufficient power required by the PDP driving apparatus.

The reset square wave signal X_rr_sig of the X-rising timing amplified in the gate driver 540A is inputted to the push-pull buffer 540C. The output voltage of the regulator 540B is applied to a supply power terminal of the push-pull buffer 540C.

If the reset square wave signal X_rr_sig of a X-rising timing is a "HIGH" state, a transistor Q1 of the push-pull buffer 540C is switched on so that a gate current $i_g$ of the MOSFET switch X31 of the switching circuit 540D is expressed as in the following Equation 3:

$$i_g = \frac{V_0}{R_e} \tag{3}$$

At this time, a voltage rising gradient $dV_{gd}/dt$ at both ends of a capacitor $C_{gd}$ of the switching circuit 540D is expressed as in the following Equation 4:

$$\frac{dV_{gd}}{dt} = \frac{dV_{ds}}{dt} = \frac{i_g}{C_{gd}} = \frac{V_0}{C_{gd}} \tag{4}$$

As seen from the above Eequation 4, if a supply voltage V*o* of the push-pull buffer 540C is adjusted, a voltage gradient between the drain terminal and the source terminal of the MOSFET switch is changed, so that a voltage gradient at both ends of the PDP is adjusted according to the supply voltage V*o*.

As explained above, the supply voltage V*o* of the push-pull buffer 540C is an output voltage of the regulator 540B and the regulator 540B follows a voltage of the gradient reference signal X_rr_sig,ref of the X-rising ramp waveform.

Thus, the gradient of the X-rising ramp waveform can be automatically adjusted in a most suitable state for eliminating the wall charge in the reset period in consideration of contrast information and brightness information sensed by the sensor 520.

Figure 6:
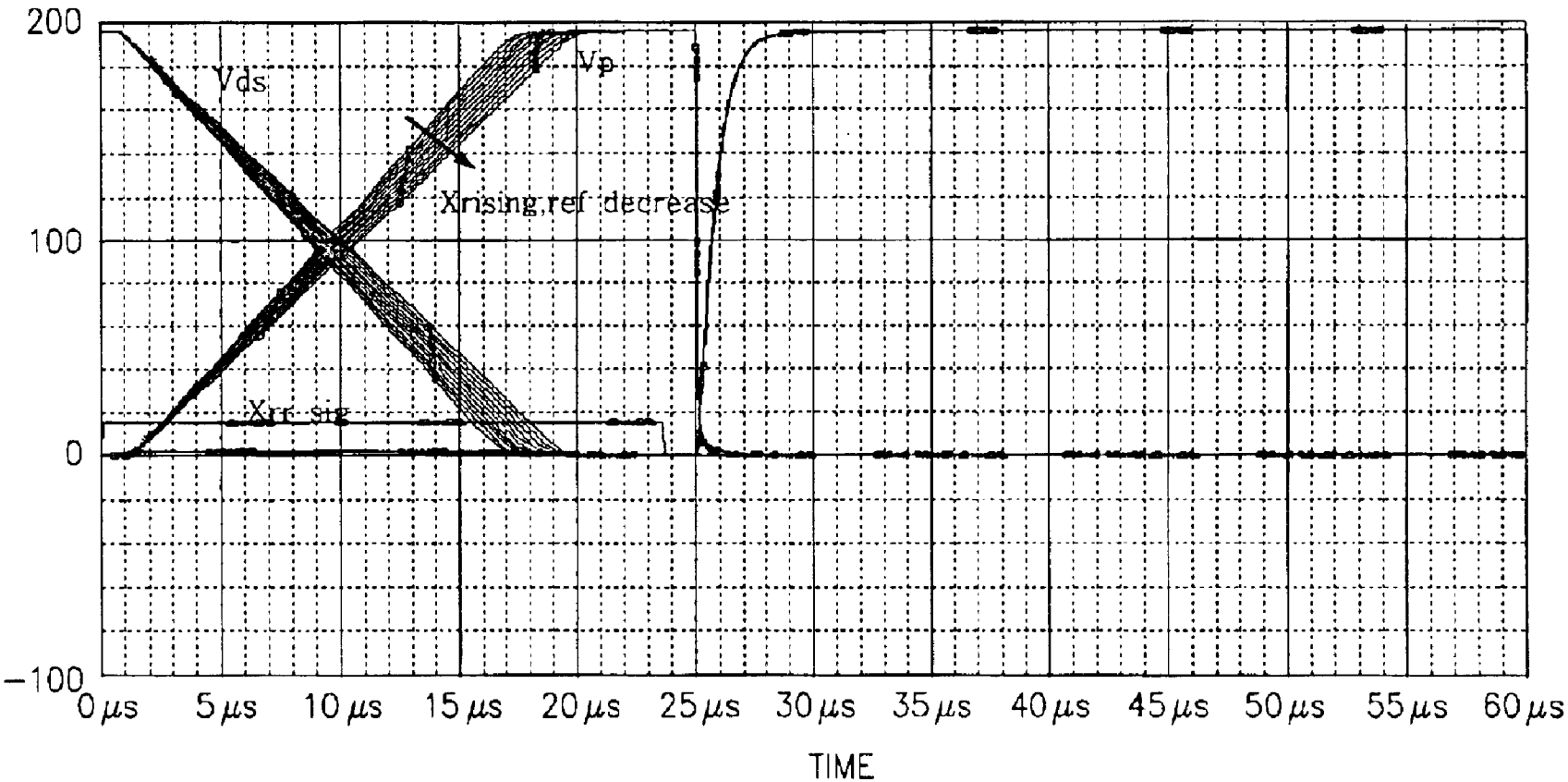
FIG. 6 is a diagram of a change of a voltage gradient of the X-rising ramp waveform of the PDP according to an output voltage change of a digital-to-analogue converter (DAC) in the circuit of FIG. 5.

FIG. 6 shows a simulation result of the X rising voltage gradient of the PDP according to a change of the gradient reference signal X_rr_sig,ref of the X-rising ramp waveform, which is the output signal of the D/A converter 530D using $P_{spice}$.

The scan electrode driver circuit 550 can automatically adjust gradients of a Y-rising ramp waveform and Y-falling ramp waveform in a most suitable state based on contrast information and brightness information sensed by the sensor 520 using the same method as the gradient adjusting method of the X-rising ramp waveform.

Figure 7:
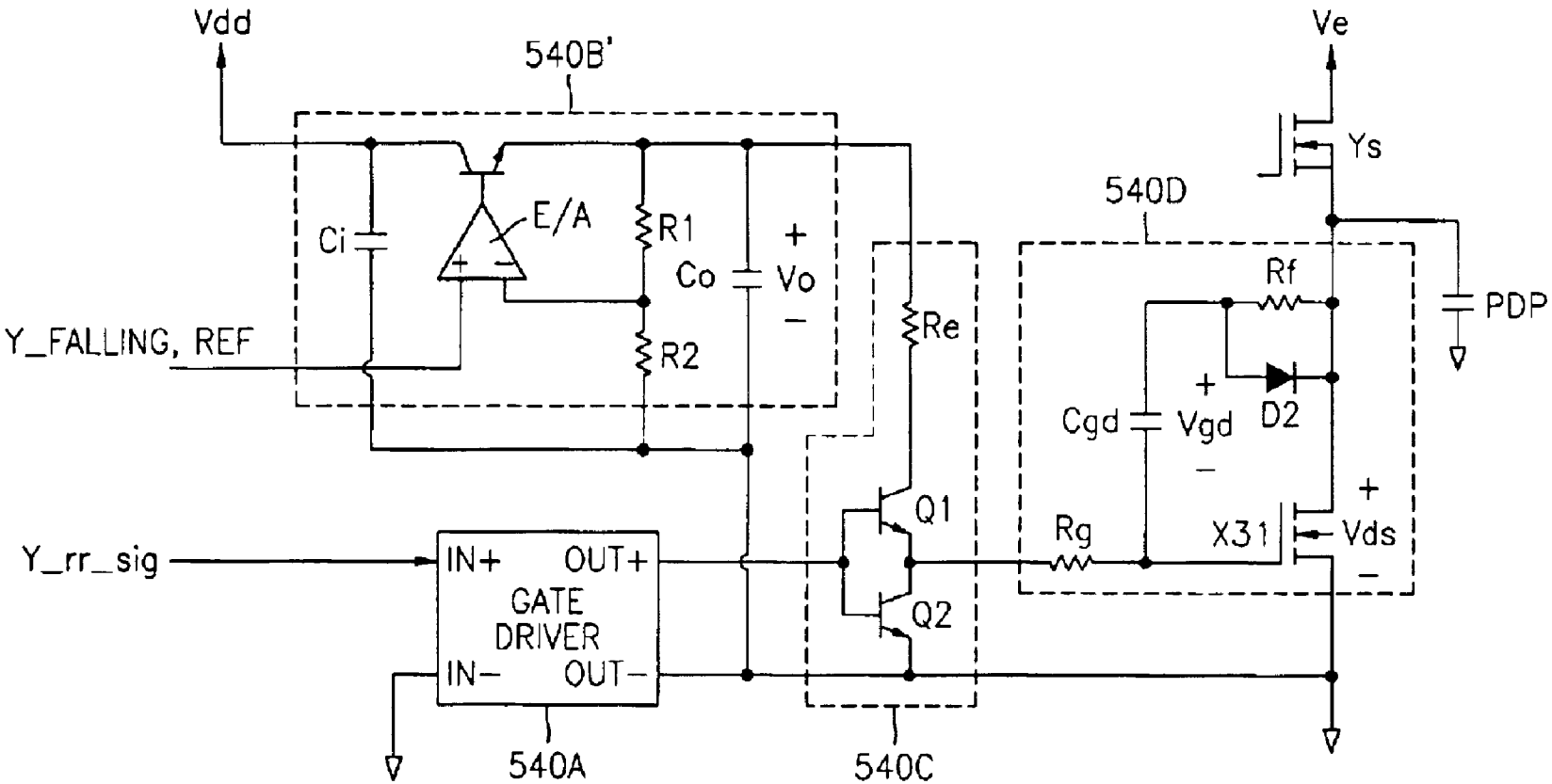
FIG. 7 is a detail circuit diagram of a Y-falling ramp waveform generating circuit according to the present invention.

FIG. 7 shows a Y-falling ramp waveform generating circuit for automatically adjusting a gradient of a Y-falling ramp waveform based on the gradient reference data of the reset ramp waveform read from the lock-up table storing means.

The Y-falling ramp waveform generating circuit of FIG. 7 has the same circuit configuration compared with the X-rising ramp waveform generating unit 540 of FIG. 5 except that the photo coupler 540E is not used.

The reason the photo coupler 540E is not used in a Y-falling ramp waveform generating circuit is that the source terminal of the MOSFET switch X31 of the switching circuit 540D is connected to the ground line, so that the input ground line and output ground line need not be separated.

A Y-rising ramp waveform generating circuit also has the same circuit configuration as the Y-falling ramp waveform generating circuit, except that signals inputted to a regulator 540B' and a gate driver 540A are a gradient reference signal Y_rr_sig,ref of the Y-rising ramp waveform and a reset square wave signal Y_rr_sig of a Y-rising timing.

The method for automatically adjusting the reset ramp waveform of the PDP according to present invention is carried out as follows.

First, image information related to a gradient adjustment of the reset ramp waveform of the PDP is sensed through the sensor.

Next, gradient reference data of the reset ramp waveform corresponding to the image information sensed in the first step is read by a look-up table.

Finally, a reset ramp waveform signal having a gradient corresponding to the gradient reference data of the reset ramp waveform read in the second step is generated. As already described in FIG. 5, this operation may be understood as a regulator following a voltage of the gradient reference signal of the reset ramp waveform and outputting the voltage, and it can be achieved by a circuit in which the gradient of the reset ramp waveform is automatically changed according to the output voltage by the regulator.

As described above, the apparatus and method of the present invention have the following advantages: since the reset ramp waveform gradient need not be manually adjusted, the apparatus manufacturing process is simple, and the adjusting deviation caused by a manual operation decreases, by sensing the image information related to the reset ramp waveform gradient of the PDP through the sensor, and automatically generating a ramp waveform of the most suitable gradient based on the sensed image information.

The present invention can be carried out as a method, apparatus and system, and so on. When the present invention is carried out as software, components of the present invention are code segments carrying out necessary operations. Program or code segments can be stored in a processor readable media, or can be transmitted by a computer date signal coupled with a carrier in a transmission media or communication network. The processor readable media includes any media capable of storing or transmitting information. The processor readable media is examples of an electronic circuit, semiconductor memory device, ROM (read only memory), flash memory, $E^2$PROM (erasable programmable read only memory), floppy disc, optical disc, hard disc, optical fiber media and radio frequency (RF) network. The computer date signal includes any signal capable of propagating on a transmission media such as an electronic network channel, optical fiber, air, electromagnetic field, RF network.

While the present invention has been particularly shown and described with reference to preferred embodiments thereof, it will be understood by those of ordinary skill in the art that various changes in form and details may be made therein without departing from the spirit and scope of the present invention as defined by the appended claims.

What is claimed is:

1. An apparatus for automatically adjusting a reset ramp waveform of a plasma display panel, comprising:

a sensor which senses image information related to a gradient adjustment of the reset ramp waveform of the plasma display panel;

a look-up table which stores gradient reference data of the reset ramp waveform corresponding to digital date value of the image information related to the gradient adjustment of the reset ramp waveform;

a control circuit which converts the sensed image information into digital data, reads the reset ramp waveform gradient reference data corresponding to the converted digital data value of image information from the look-up table, and converts the read gradient reference data into an analogue signal; and a ramp waveform generating circuit which changes a gradient of the reset ramp waveform according to a level of the reset ramp waveform gradient reference signal which is converted into the analogue signal.

2. The apparatus of claim 1, wherein the image information related to the gradient adjustment of the reset ramp waveform is contrast information.

3. The apparatus of claim 1, wherein the image information related to the gradient adjustment of the reset ramp waveform is brightness information.

4. The apparatus of claim 1, wherein the reset ramp waveform gradient reference data includes Y-rising ramp waveform gradient reference data, Y-falling ramp waveform gradient reference data of a scan electrode and X-rising ramp waveform gradient reference data of a common electrode.

5. The apparatus of claim 1, wherein the ramp waveform generating circuit includes a Y-rising ramp waveform generating unit, a Y-falling ramp waveform generating unit of a scan electrode and an X-rising ramp waveform generating unit of a common electrode.

6. The apparatus of claim 5, wherein the X-rising ramp waveform generating unit includes:

a photo coupler which converts the reset ramp waveform gradient reference signal into a signal based on a voltage of a plasma common electrode terminal through a ground line separation of an input/output terminal and outputs the signal;

a regulator which inputs the output voltage of the photo coupler and follows and outputs the input voltage;

a buffer which inputs and amplifies a reset square wave signal using the output voltage by the regulator as a supply voltage; and a switching circuit which includes predetermined passive circuit elements for converting the reset square wave signal outputted from the buffer into a ramp waveform signal.

7. The apparatus of claim 6, wherein the reset square wave signal is an output signal amplified by a gate driver which amplifies a voltage.

8. The apparatus of claim 6, wherein the regulator includes a linear regulator.

9. The apparatus of claim 6, wherein the regulator includes a switch mode power supply (SMPS).

10. The apparatus of claim 6, wherein the buffer includes a push-pull buffer.

11. The apparatus of claim 6, wherein the switching circuit includes a MOS field effect transistor (MOSFET), a resistor, a capacitor and a diode, the resistor and capacitor are serially connected between a gate terminal and a drain terminal of the MOSFET, the diode is parallelly connected to both ends of the capacitor, a source terminal of the MOSFET is connected to a common electrode terminal of the plasma display panel, and a supply voltage is applied to the drain terminal of the MOSFET.

12. The apparatus of claim 5, wherein the Y-rising ramp waveform generating unit or the Y-falling ramp waveform generating unit includes:

a regulator which inputs the reset ramp waveform gradient reference signal and follows and outputs a voltage of the reset ramp waveform gradient reference signal;

a buffer which inputs and amplifies a reset square wave signal using the output voltage by the regulator as a supply voltage; and a switching circuit which includes predetermined passive circuit components for converting the reset square wave signal outputted from the buffer into a ramp waveform signal.

13. The apparatus of claim 12, wherein the reset square wave signal is an output signal amplified by a gate driver which amplifies a voltage.

14. The apparatus of claim 12, wherein the regulator includes a linear regulator.

15. The apparatus of claim 12, wherein the regulator includes a switch mode power supply (SMPS).

16. The apparatus of claim 12, wherein the buffer includes a push-pull buffer.

17. The apparatus of claim 12, wherein the switching circuit includes a MOS field effect transistor (MOSFET), a resistor, a capacitor and a diode, the resistor and capacitor are serially connected between a gate terminal and a drain terminal of the MOSFET, the diode is parallelly connected to both ends of the capacitor, a source terminal of the MOSFET is connected to a common electrode terminal of the plasma display panel, and a supply voltage is applied to the drain terminal of the MOSFET.

18. An apparatus for driving a plasma display panel, comprising:

a sensor which senses image information related to a gradient adjustment of a reset ramp waveform of the plasma display panel;

a look-up table which stores reset ramp waveform gradient reference data, which corresponds to digital data value of the image information related to the gradient adjustment of the reset ramp waveform and is applied to a reset common electrode and reset scan electrode, respectively;

a control circuit which converts the sensed image information by the sensor into digital data, reads the reset ramp waveform gradient reference data which corresponds to the converted digital data value of image information and is respectively applied to the reset common electrode and the reset scan electrode from the look-up table, and converts the read ramp waveform gradient reference data into an analogue signal;

a common electrode driving circuit which includes a common electrode ramp waveform generating circuit which changes the reset ramp waveform gradient applied to the reset common electrode according to a level of the reset ramp waveform gradient reference signal applied to the reset common electrode which is converted into the analogue signal, thereby generating a driving voltage of the common electrode of the plasma display panel; and a scan electrode driving circuit which includes a scan electrode ramp waveform generating circuit which changes the reset ramp waveform gradient applied to the reset scan electrode according to a level of the reset ramp waveform gradient reference signal applied to the reset scan electrode which is converted into the analogue signal, thereby generating a driving voltage to the scan electrode of the plasma display panel.

19. A method for controlling a drive of a plasma display, comprising:

sensing image inflation related to a gradient adjustment of a reset ramp waveform of the plasma display panel through a sensor;

reading reset ramp waveform gradient reference data corresponding to the sensed image information related to the gradient adjustment of the reset ramp waveform from a look-up table; and generating a reset ramp wave signal having a gradient corresponding to the read reset ramp waveform gradient reference data value.

20. The method of claim 19, wherein the image information related to the gradient adjustment of the reset ramp waveform is contrast information.

21. The method of claim 19, wherein the image information related to the gradient adjustment of the reset ramp waveform is brightness information.

22. The method of claim 19, wherein the reset ramp waveform gradient reference data includes Y-rising ramp waveform gradient reference data, Y-falling ramp waveform gradient reference data of a scan electrode and X-rising ramp waveform gradient reference data of a common electrode.

* * * * *